United States Patent [19]

Dougan

[11] 4,092,752

[45] June 6, 1978

[54] FIRE RETARDANT BOX SPRING AND MATTRESS

[75] Inventor: Thomas P. Dougan, Newport Beach, Calif.

[73] Assignee: The Upjohn Company, Kalamazoo, Mich.

[21] Appl. No.: 745,690

[22] Filed: Nov. 29, 1976

[51] Int. Cl.[2] ..... A47C 23/00; B29H 17/28

[52] U.S. Cl. ..... 5/345 R; 5/351; 5/354; 5/355; 260/2.5 AJ

[58] Field of Search ..... 5/345 R, 351, 354, 355, 5/361 B; 260/2.5 AJ; 297/DIG. 5

[56] References Cited

U.S. PATENT DOCUMENTS

| | | | |
|---|---|---|---|
| 3,512,192 | 5/1970 | Simon | 5/361 R |
| 3,670,348 | 6/1972 | Irwin | 5/345 R |
| 3,738,953 | 6/1973 | Anorga et al. | 260/2.5 AJ |
| 3,818,521 | 6/1974 | Richards, Jr. | 5/345 R |
| 3,909,464 | 9/1975 | Anorga et al. | 260/2.5 AJ |

*Primary Examiner*—Casmir A. Nunberg
*Attorney, Agent, or Firm*—Denis A. Firth; John Kekich

[57] ABSTRACT

An improved combination of box spring and mattress is provided. The mattress has a core of a particular class of flame-retarded flexible polyurethane foam and, optionally, has an outer layer of flexible polyimide foam fabricated to surround said core. The foam core, optionally with outer layer of polyimide foam, is enclosed in a flame retardant or retarded ticking (flame retarded cotton, polyvinyl chloride, fiber glass cloth, high temperature resistant polymeric fiber cloth). The box spring has a non-combustible frame and, optionally, is padded with a flame retarded flexible polyurethane foam, such as that used in the aforesaid mattress, or a flexible polyimide foam.

The box spring and mattress combination meets the requirements of present institutional fire codes and the like and represents a significantly improved product for commercial and domestic household use.

6 Claims, 3 Drawing Figures

FIRE RETARDANT BOX SPRING AND MATTRESS

BACKGROUND OF THE INVENTION

1. Field of the Invention

This invention relates to cushioning materials and is more particularly concerned with a box spring and mattress combination.

2. Description of the Prior Art

The very strict requirements of federal, state and local fire codes for mattresses and related materials used in institutions such as hospitals, hotels, detention establishments and the like and in maritime vessels, aircraft and the like, are now such that mattresses and or box springs, fabricated from materials hitherto conventionally used, are no longer acceptable for such uses.

Various forms of fire retardant mattress have been reported. For example, U.S. Pat. No. 3,512,192 describes the preparation of a mattress in the form of a laminate of a plurality of layers of polyurethane foam separated by layers of fiber glass.

Very recently there have been described flexible polyurethane foams which are capable of passing the tests established for the uses set forth above; see U.S. Pat. Nos. 3,738,953 and 3,909,464. The principal such tests are the Hot Bolt Test (Military Specification Mil R-20092F) and, more particularly, the Federal Flammability Standard for Mattresses DOC FF4-72. Unfortunately, while the foam itself will pass the necessary tests, it is found that, when said foam is fabricated as a mattress using conventional covering fabrics (i.e. ticking), or even using substantially non-flammable coverings such as fiber glass cloth, and is combined with conventional box springs, the resulting combination can cause a serious fire hazard. This is particularly so in the case of a fire which originates in the room in which the mattress and box spring combination is housed even though the fire may not originate within the latter combination itself. In such instances it is found that conventional mattress and box spring combinations, even those in which the mattress core is a flame retarded polyurethane or like foam, are capable of contributing significantly to the resulting fire and the toxic fumes generated thereby and may even facilitate spread of said fire.

I have now found box spring and mattress combinations which are substantially free of such hazards and which will pass the above, very severe, tests. These combinations are, accordingly, acceptable for uses of the type discussed above, as well as for domestic use.

SUMMARY OF THE INVENTION

This invention comprises an improved box spring and mattress combination, said mattress being supported on said box spring wherein said mattress comprises:

a core of flame retarded flexible polyurethane foam which is the product of reaction, under foam producing conditions, of (a) a polyisocyanate mixture which contains from 5 percent to 95 percent by weight of toluene diisocyanate and from 95 percent to 5 percent by weight of polymethylene polyphenyl polyisocyanate containing from about 40 to about 70 percent of methylenebis(phenyl isocyanate), the remainder of said polymethylene polyphenyl polyisocyanates having a functionality higher than 2.0;

(b) a polyether polyol having an equivalent weight from about 500 to about 2500 and a functionality from about 2.0 to about 4.0;

(c) from about 2 to about 20 percent by weight, based on weight of final foam, of antimony oxide;

(d) from about 1 to about 15 percent by weight, based on weight of final foam, of a polyhalogenated member selected from the class consisting of polyhalogenated aliphatic diols and polyhalogenated aromatic compounds; and (e) from 0 to about 15 percent by weight, based on weight of final foam, of alumina trihydrate; and (f) in the case when the amount of alumina trihydrate is 0, a chlorinated hydrocarbon polymer in an amount such that the resultant foam contains from about 2 to about 8 percent by weight of chlorine;

said core of flame retarded polyurethane foam being enclosed in a covering of flame retardant ticking; and said box spring comprising a non-combustible frame.

In a preferred embodiment of the invention the polyurethane foam core of the mattress has an outer layer of flexible polyimide foam bonded thereto.

DETAILED DESCRIPTION OF THE INVENTION

A better understanding of the invention will be obtained by reference to the drawings.

Figure 1:
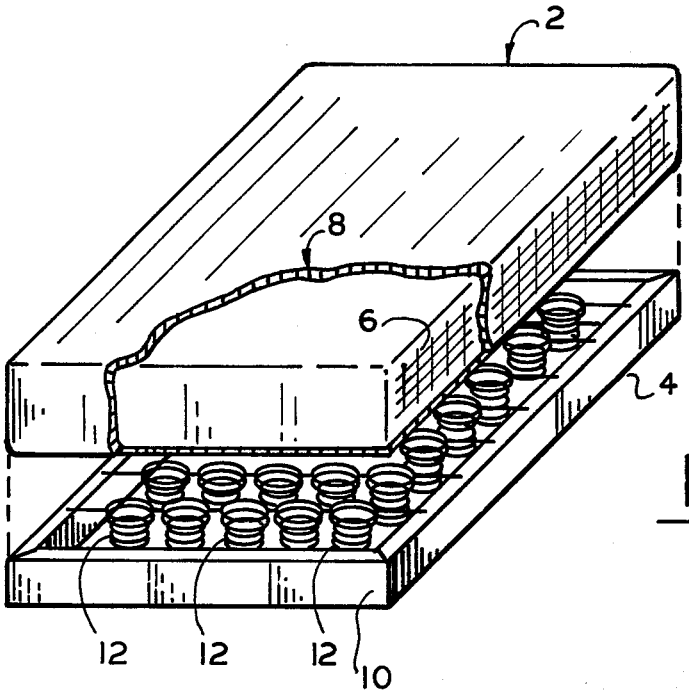
FIG. 1 shows an exploded perspective view with partial cutaway of a combination of box spring and mattress according to the invention.

Referring to FIG. 1 there is shown a mattress 2 and box spring 4 in an exploded view for ease of understanding. It goes without saying that the mattress 2 will ordinarily rest upon, and be supported by, box spring 4. The mattress 2 has an inner core 6 which is fabricated from fire retardant flexible polyurethane foam and a cover or ticking 8. The flexible polyurethane foam core 6 can be molded, or be fabricated by cutting from larger buns and the like, from any of the fire retardant flexible foams prepared as described in U.S. Pat. Nos. 3,738,953 and 3,909,464, the disclosures of which are hereby incorporated by reference. Said core 6 advantageously has a density in the range of about 1.85 pcf to about 4 pcf and preferably in the range of about 2 pcf to about 3 pcf. Said core 6 advantageously has a thickness in the range of about 3 inches to about 8 inches and its overall dimensions can vary within the limits traditionally observed in the mattress art.

The cover or ticking 8 is fabricated from flame retarded or inherently non-flammable material such as fiber glass cloth, flame retarded fabrics based on cotton, polyvinyl chloride, polyamides, polyimides, and the like, and is constructed in accordance with the well recognized art in this field.

The box spring 4 has an outer metal frame of angle beam 10 which supports a matrix of metal springs 12.

Figure 2:
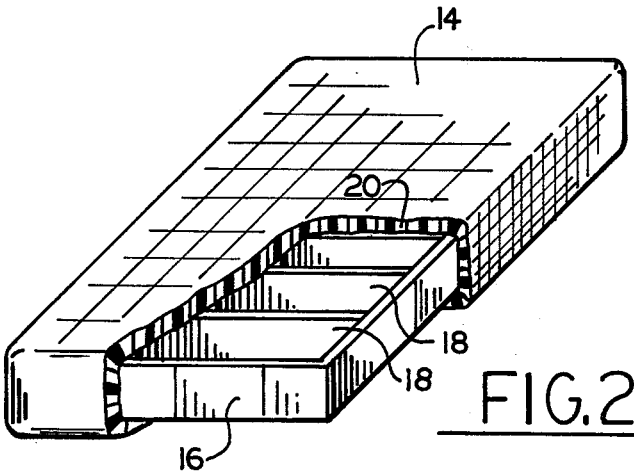
FIG. 2 shows a perspective view of an alternative form of box spring which may be used in combination with a mattress in accordance with the invention.

In FIG. 2 there is shown an alternative form of box spring 14 to be employed in the combinations of the invention. In the box spring 14 a metal or reinforced fiber glass frame 16 provided with supporting struts 18 is covered, at least on the top and sides, with a layer of flexible foam 20. The latter can be, for example, any of the fire retardant flexible foams disclosed in U.S. Pat. Nos. 3,734,953 and 3,909,464, or the flexible polyimide foams disclosed in U.S. Pat. Nos. 3,966,652. The foam is applied by spraying the appropriate foam mix on to the frame or by cutting appropriate sheets of foam and bonding said sheets to the frame 16 using adhesives and the like. Advantageously the thickness of the foam layer 20 is in the range of about 1 to about 3 inches depending on the degree of cushioning required. The density of said foam is advantageously in the range of about 2 to about 6 pcf. The frame 16 can be readily adapted to house drawers (fabricated from non-combustible material such as metal or fiber glass) and the like for storage purposes.

Figure 3:
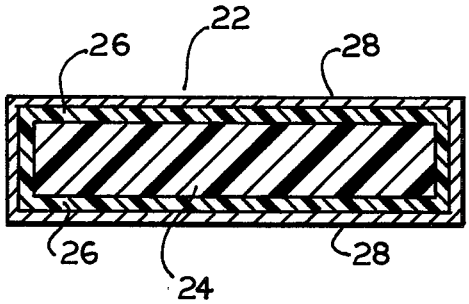
FIG. 3 shows a cross-sectional view of an embodiment of a preferred form of mattress in accordance with the invention.

In FIG. 3 there is shown an alternative embodiment of a mattress 22 in accordance with the invention. The mattress 22 comprises an inner core 24 of flexible polyurethane foam of the type discussed above which has bonded thereto, on top and bottom, layers 26 of flexible polyimide foam. The latter layers generally have a thickness of about ¼ inch to about 1 inch and preferably about ½ inch to about ¾ inch whereas the inner core layer has a significantly greater thickness in the range set forth above for the single layer mattress. Examples of flexible polyimide foams which can be employed in the above manner are the copolyimide foams derived by reacting benzophenone tetracarboxylic acid dianhydride with a mixture of 2,6-diaminopyridine (or like heterocyclic diamines) and 4,4'-diaminodiphenylsulfone (or isomers thereof) in accordance with the precedures disclosed in U.S. Pat. No. 3,966,652.

The flexible polyimide layer 26 is preferably fabricated in the form of sheets of the appropriate thickness which are then cut to size and bonded to the inner core 24 using appropriate adhesives.

The mattress 22 also has an outer layer of ticking 22 which is fabricated from the materials previously discussed for this same purpose.

I have found that the combination of the inner core 24 of flexible polyurethane foam and the outer layer 26 of flexible polyimide foam still retains the necessary resiliency properties, in particular excellent compression set and indentation load deflection properties, required for satisfactory performance in a mattress. This finding is surprising since the material of the outer layer of the combination has resiliency properties which are too poor to permit this material to be used alone in the fabrication of mattresses.

In a further modification of the two layer mattress shown in FIG. 3 I have found that the inner core 24 can be fabricated from flexible polyurethane foam having much inferior flame retardant properties, as compared with those foams disclosed in the aforesaid U.S. Pat. Nos. 3,738,953 and 3,909,464, without detracting from the ability of the combination to resist exposure to open flames, such as the flame of a blow torch, for prolonged periods.

The combination of box spring and mattress provided by my invention is characterized by the ability to pass very stringent tests for evidence of hazards created by exposure to fire.

Illustratively, in a test which involved igniting a pile of newspapers under the box spring and mattress and allowing the resulting fire to burn without control, a box spring and mattress combination fabricated in accordance with the invention resisted ignition throughout the whole period for which the paper was burning, whereas a conventional box spring and mattress combination (wherein the mattress was fabricated from the same flame retarded foam as that used in the combination of the invention) readily ignited under exactly the same conditions and was totally consumed by the fire. It is believed that the combination of the invention is the first to meet such rigid standards.

It is to be understood that the above embodiments have been provided for purposes of illustration only and are not to be construed as limiting. Various modifications thereto can be made without departing from the spirit and scope of the invention, the latter being defined by the following claims.

I claim:

1. An improved box spring and mattress combination, said mattress being supported on said box spring wherein said mattress consists essentially of a homogeneous core of flame retarded flexible polyurethane foam which is the product of reaction, under foam producing conditions, of (a) a polyisocyanate mixture which contains from 5 percent to 95 percent by weight of toluene diisocyanate and from 95 percent to 5 percent by weight of polymethylene polyphenyl polyisocyanate containing from about 40 percent to about 70 percent of methylenebis(phenyl isocyanate), the remainder of said polymethylene polyphenyl polyisocyanates having a functionality higher than 2.0;

(b) a polyether polyol having an equivalent weight from about 500 to about 2500 and a functionality from about 2.0 to about 4.0;

(c) from about 2 to about 20 percent by weight, based on weight of final foam, of antimony oxide;

(d) from about 1 to about 15 percent by weight, based on weight of final foam, of a polyhalogenated member selected from the class consisting of polyhalogenated aliphatic diols and polyhalogenated aromatic compounds; and (e) from 0 to about 15 percent by weight, based on weight of final foam, of alumina trihydrate; and (f) when the amount of alumina trihydrate is zero, a chlorinated hydrocarbon polymer in an amount such that the resultant foam contains from about 2 to about 8 percent by weight of chlorine;

said core of flame retarded polyurethane foam being enclosed in a covering of flame retardant ticking; and said box spring comprising a non-combustible frame.

2. A box spring and mattress combination according to claim 1 wherein the covering of flame retardant ticking is fabricated from fiber glass cloth.

3. A box spring and mattress combination according to claim 1 wherein said box spring comprises a non-combustible frame which is provided on the upper surface thereof with a padding of flame retardant flexible foam of substantially the same composition as that employed in the core of said mattress.

4. A box spring and mattress combination according to claim 1 wherein said box spring comprises a non-combustible frame which is padded on the upper surface thereof with a layer of flexible polyimide foam.

5. A box spring and mattress combination according to claim 1 wherein the core of said mattress is covered by and bonded to a relatively thin layer, compared to the thickness of said core, of a flexible polyimide foam.

6. A mattress comprising in combination:

a core of flame retarded polyurethane foam which is the product of reaction, under foam producing conditions, of (c) a polyisocyanate mixture which contains from 5 percent to 95 percent by weight of toluene diisocyanate and from 95 percent to 5 percent by weight of polymethylene polyphenyl polyisocyanate containing from about 40 percent to about 70 percent of methylenebis(phenyl isocyanate), the remainder of said polymethylene polyphenyl polyisocyanate having a functionality higher than 2.0;

(b) a polyether polyol having an equivalent weight from about 500 to 2500 and a functionality from about 2.0 to about 4.0;

(c) from about 2 to about 20 percent by weight, based on weight of final foam, of antimony oxide;

(d) from about 1 to about 15 percent by weight based on weight of final foam, of a polyhalogenated member selected from the class consisting of polyhalogenated aliphatic diols and polyhalogenated aromatic compounds;

(e) from 0 to about 15 percent by weight, based on weight of final foam, of alumina trihydrate; and (f) when the amount of alumina trihydrate is zero, a chlorinated hydrocarbon polymer in an amount such that the resultant foam contains from about 2 to about 8 percent by weight of chlorine; and a relatively thin layer of flexible polyimide foam surrounding and bonded to said core.

* * * * *